US010433393B2

(12) United States Patent
Johannessen et al.

(10) Patent No.: US 10,433,393 B2
(45) Date of Patent: Oct. 1, 2019

(54) FLEXIBLE LED LIGHTING ELEMENT

(71) Applicant: B/E Aerospace, Inc., Wellington, FL (US)

(72) Inventors: Eric Johannessen, Holbrook, NY (US); Jonathan Todzia, Farmingville, NY (US); Donald LaSala, Seaford, NY (US); Gannon T. Gambeski, St. James, NY (US); Matthew Dunn, Stony Brook, NY (US); Luis Sam, South Setauket, NY (US)

(73) Assignee: B/E Aerospace, Inc., Wellington, FL (US)

( * ) Notice: Subject to any disclaimer, the term of this patent is extended or adjusted under 35 U.S.C. 154(b) by 0 days.

(21) Appl. No.: 16/231,049

(22) Filed: Dec. 21, 2018

(65) Prior Publication Data

US 2019/0116642 A1 Apr. 18, 2019

Related U.S. Application Data

(60) Continuation of application No. 15/804,156, filed on Nov. 6, 2017, now Pat. No. 10,206,262, which is a (Continued)

(51) Int. Cl.
*H05B 33/08* (2006.01)
*F21V 3/04* (2018.01)

(Continued)

(52) U.S. Cl.
CPC ..... *H05B 33/0869* (2013.01); *F21K 9/64* (2016.08); *F21V 3/049* (2013.01); *F21V 23/003* (2013.01);

(Continued)

(58) Field of Classification Search
CPC ..... F21Y 2113/00; F21Y 2105/001; F21Y 2105/003; F21Y 2111/007

(Continued)

(56) References Cited

U.S. PATENT DOCUMENTS 4,729,742 A 3/1988 Onishi et al.
4,885,430 A * 12/1989 Kinser, Jr. ..... H01H 13/702 361/749

(Continued)

FOREIGN PATENT DOCUMENTS

EP 1901587 A2 3/2008
JP 2003524284 A 8/2003

(Continued)

OTHER PUBLICATIONS

Muratest, Calibration of LED Displays, Application Note, May 2007, <http://www.google.com/url?sa=t&rct=j&q=led+%22target+color%22+calibration+coefficients+color+filetype:pdf&source=web&cd=1&cad=rja&ved=0CC0QFjAA&url=http%3A%2F%2Fwww.eidim.fr%2Flibrary%2Fapplication-notes-1%2Fapplication_note-ledwall.pdf&ei=8wq2U13xFMHLyQHn8YGQDA&usg=AFQjCNGd29M60KhUjWyOzglQ21aaer-sww>, 3 pages.

(Continued)

*Primary Examiner* — Douglas W Owens
*Assistant Examiner* — Amy X Yang
(74) *Attorney, Agent, or Firm* — Donna P. Suchy; Angel N. Gerdzhikov; Daniel M. Barbieri

(57) ABSTRACT

A flexible LED lighting module includes a flexible housing and flexible PCB to which LED units are mounted. An encapsulant fills a channel of the flexible housing and has a same or similar optical refractive index value as is used in the LED unit to hold phosphorous particles used for coloring of the LED. Use of the encapsulant changes the color of the light ultimately emitted from the flexible LED lighting module, and this factor is corrected for in calibration processes associated with the flexible LED lighting module.

9 Claims, 14 Drawing Sheets

Related U.S. Application Data division of application No. 14/877,534, filed on Oct. 7, 2015, now abandoned, which is a continuation-in-part of application No. 14/697,273, filed on Apr. 27, 2015, now Pat. No. 9,414,459, which is a continuation of application No. 13/650,289, filed on Oct. 12, 2012, now Pat. No. 9,018,853, which is a continuation-in-part of application No. 13/035,329, filed on Feb. 25, 2011, now Pat. No. 9,018,858, which is a continuation-in-part of application No. 12/566,146, filed on Sep. 24, 2009, now Pat. No. 8,378,595.

(60) Provisional application No. 62/173,855, filed on Jun. 10, 2015, provisional application No. 61/546,259, filed on Oct. 12, 2011, provisional application No. 61/345,378, filed on May 17, 2010, provisional application No. 61/320,545, filed on Apr. 2, 2010, provisional application No. 61/308,171, filed on Feb. 25, 2010, provisional application No. 61/105,506, filed on Oct. 15, 2008, provisional application No. 61/099,713, filed on Sep. 24, 2008.

(51) Int. Cl.

| | |
|---|---|
| ***F21K 9/64*** | (2016.01) |
| ***F21V 23/00*** | (2015.01) |
| *F21Y 103/10* | (2016.01) |
| *F21Y 115/10* | (2016.01) |
| *F21Y 113/13* | (2016.01) |

(52) U.S. Cl.
CPC ..... *H05B 33/0803* (2013.01); *H05B 33/0827* (2013.01); *F21Y 2103/10* (2016.08); *F21Y 2113/13* (2016.08); *F21Y 2115/10* (2016.08)

(58) Field of Classification Search
USPC ..... 315/153, 209, 312
See application file for complete search history.

(56) References Cited

U.S. PATENT DOCUMENTS

| | | | | |
|---|---|---|---|---|
| 5,003,432 | A | 3/1991 | Mandy | |
| 5,490,048 | A | 2/1996 | Brassier et al. | |
| 5,677,603 | A | 10/1997 | Speirs et al. | |
| 5,825,135 | A | 10/1998 | Chang | |
| 5,848,837 | A * | 12/1998 | Gustafson | B64F 1/002 362/235 |
| 6,016,038 | A | 1/2000 | Mueller et al. | |
| 6,211,626 | B1 | 4/2001 | Lys et al. | |
| 6,220,721 | B1 | 4/2001 | Chan et al. | |
| 6,371,637 | B1 | 4/2002 | Atchinson et al. | |
| 6,441,558 | B1 | 8/2002 | Muthu et al. | |
| 6,521,915 | B2 * | 2/2003 | Odaki | C09K 11/7731 257/100 |
| 6,815,842 | B2 | 11/2004 | Fehd et al. | |
| 7,081,925 | B2 | 7/2006 | Yang et al. | |
| 7,114,827 | B2 | 10/2006 | Halter | |
| 7,161,556 | B2 | 1/2007 | Morgan et al. | |
| 7,173,383 | B2 | 2/2007 | Vomsand et al. | |
| 7,198,387 | B1 | 4/2007 | Gloisten et al. | |
| 7,266,315 | B2 | 9/2007 | Sato | |
| 7,375,476 | B2 | 5/2008 | Walter et al. | |
| 7,443,104 | B2 | 10/2008 | Zwanenburg et al. | |
| 7,494,255 | B2 | 2/2009 | Bryan et al. | |
| 7,515,128 | B2 | 4/2009 | Dowling | |
| 7,658,506 | B2 | 2/2010 | Dowling | |
| 7,696,964 | B2 | 4/2010 | Lankhorst et al. | |
| 7,717,593 | B2 | 5/2010 | Clark | |
| 7,717,594 | B2 | 5/2010 | Clark | |
| 7,718,942 | B2 | 5/2010 | Lim et al. | |
| 7,744,242 | B2 | 6/2010 | Kramer | |
| 7,850,341 | B2 | 12/2010 | Mrakovich et al. | |
| 7,868,562 | B2 | 1/2011 | Salsbury et al. | |
| 7,893,633 | B2 * | 2/2011 | Pedersen | H05B 33/0827 315/297 |
| 8,193,737 | B2 | 6/2012 | Peker et al. | |
| 8,212,466 | B2 | 7/2012 | Negley et al. | |
| 8,264,448 | B2 | 9/2012 | Shteynberg et al. | |
| 8,278,840 | B2 | 10/2012 | Logiudice et al. | |
| 8,278,846 | B2 | 10/2012 | Roberts et al. | |
| 8,723,450 | B2 | 5/2014 | Hatley et al. | |
| 8,901,850 | B2 | 12/2014 | Maxik et al. | |
| 8,928,249 | B2 | 1/2015 | Raj et al. | |
| 9,018,853 | B2 | 4/2015 | Johannessen et al. | |
| 9,018,858 | B2 | 4/2015 | Gambeski et al. | |
| 9,024,529 | B2 | 5/2015 | Yan et al. | |
| 2002/0001193 | A1 | 1/2002 | Osawa et al. | |
| 2003/0208764 | A1 | 11/2003 | Galipeau et al. | |
| 2004/0183480 | A1 | 9/2004 | Halter | |
| 2004/0240211 | A1 | 12/2004 | Rodgers et al. | |
| 2005/0036159 | A1 | 2/2005 | Sharma et al. | |
| 2005/0174309 | A1 | 8/2005 | Bouwens et al. | |
| 2005/0202785 | A1 | 9/2005 | Meyer | |
| 2005/0275912 | A1 | 12/2005 | Chen et al. | |
| 2006/0187081 | A1 | 8/2006 | Gloisten et al. | |
| 2006/0237636 | A1 | 10/2006 | Lyons et al. | |
| 2007/0018181 | A1 | 1/2007 | Steen et al. | |
| 2007/0034775 | A1 | 2/2007 | Cheng et al. | |
| 2007/0097675 | A1 | 5/2007 | Koren et al. | |
| 2007/0103646 | A1 | 5/2007 | Young | |
| 2007/0139941 | A1 | 6/2007 | Bryan et al. | |
| 2007/0236423 | A1 | 10/2007 | Chiou et al. | |
| 2007/0274084 | A1 | 11/2007 | Kan et al. | |
| 2007/0291483 | A1 | 12/2007 | Lys | |
| 2008/0089071 | A1 | 4/2008 | Wang et al. | |
| 2008/0136313 | A1 | 6/2008 | Van De Ven et al. | |
| 2008/0136334 | A1 | 6/2008 | Robinson et al. | |
| 2008/0197788 | A1 | 8/2008 | Conover et al. | |
| 2008/0215279 | A1 | 9/2008 | Salsbury et al. | |
| 2008/0266887 | A1 | 10/2008 | Wentland et al. | |
| 2009/0001251 | A1 | 1/2009 | Ng et al. | |
| 2009/0059610 | A1 | 3/2009 | Marshall et al. | |
| 2009/0140630 | A1 | 6/2009 | Kijima et al. | |
| 2009/0251898 | A1 | 10/2009 | Kinnune et al. | |
| 2010/0007588 | A1 | 1/2010 | Zygmunt et al. | |
| 2010/0008090 | A1 * | 1/2010 | Li | F21V 17/007 362/249.03 |
| 2010/0072904 | A1 | 3/2010 | Eckel et al. | |
| 2010/0188024 | A1 | 7/2010 | Deuenberg et al. | |
| 2010/0207531 | A1 | 8/2010 | Peker et al. | |
| 2011/0058372 | A1 * | 3/2011 | Lerman | H05K 1/0204 362/235 |
| 2011/0062874 | A1 | 3/2011 | Knapp | |
| 2011/0109445 | A1 | 5/2011 | Weaver et al. | |
| 2011/0141716 | A1 | 6/2011 | Wiesmann et al. | |
| 2012/0013252 | A1 | 1/2012 | Eckel et al. | |
| 2012/0019164 | A1 | 1/2012 | Gambeski et al. | |
| 2012/0206914 | A1 | 8/2012 | Oza et al. | |
| 2013/0076250 | A1 | 3/2013 | Logiudice | |
| 2013/0300282 | A1 | 11/2013 | Mori et al. | |
| 2014/0152687 | A1 | 6/2014 | Liu et al. | |
| 2015/0062890 | A1 | 3/2015 | Camarota | |
| 2015/0085466 | A1 * | 3/2015 | Edwards | F21K 9/64 362/84 |
| 2015/0092429 | A1 | 4/2015 | Speer et al. | |
| 2015/0145406 | A1 * | 5/2015 | Li | F21V 3/02 313/502 |
| 2015/0230315 | A1 | 8/2015 | Johannessen et al. | |

FOREIGN PATENT DOCUMENTS

| | | | |
|---|---|---|---|
| JP | 2004006253 | A | 1/2004 |
| JP | 2004158370 | A | 6/2004 |
| JP | 2005517278 | A | 6/2005 |
| JP | 2007109584 | A | 4/2007 |
| JP | 2007249647 | A | 9/2007 |
| JP | 2008109514 | A | 5/2008 |
| JP | 2008135224 | A | 6/2008 |
| KR | 20040066650 | A | 7/2004 |
| WO | 03067934 | A2 | 8/2003 |

(56) References Cited

FOREIGN PATENT DOCUMENTS

| | | | |
|---|---|---|---|
| WO | 2006081707 | A1 | 8/2006 |
| WO | 2007069149 | A1 | 6/2007 |
| WO | 2007083250 | A1 | 7/2007 |
| WO | 2008047335 | A1 | 4/2008 |
| WO | 2009035493 | A1 | 5/2009 |
| WO | 2011106623 | A1 | 9/2011 |
| WO | 2011110217 | A1 | 9/2011 |
| WO | 2013056012 | A1 | 4/2013 |
| WO | 2014026976 | A1 | 2/2014 |

OTHER PUBLICATIONS

PCT International Search Report and Written Opinion dated Feb. 7, 2017 in PCT/US2016/056069.
Supplementary European Search Report dated Jan. 22, 2019 for EP Application No. 16787024.5.
Partial Supplemental Search Report dated Mar. 21, 2019 for EP Patent Application No. 16854455.9.
Extended Search Report dated Apr. 10, 2019 for EP Patent Application No. 16854455.9.

* cited by examiner

FLEXIBLE LED LIGHTING ELEMENT

CROSS REFERENCE TO RELATED APPLICATIONS

This application is a continuation of U.S. patent application Ser. No. 15/804,156, filed Nov. 6, 2017, which is a divisional of U.S. patent application Ser. No. 14/877,534, filed Oct. 7, 2015. U.S. patent application Ser. No. 14/877,534 claims the benefit of U.S. Provisional Patent Application Ser. No. 62/173,855, filed Jun. 10, 2015. U.S. patent application Ser. No. 14/877,534 is also a continuation-in-part of U.S. patent application Ser. No. 14/697,273, filed Apr. 27, 2015, now U.S. Pat. No. 9,414,459, which is a continuation of U.S. patent application Ser. No. 13/650,289 filed Oct. 12, 2012, now U.S. Pat. No. 9,018,853, which claims benefit of U.S. Provisional Application No. 61/546,259 filed Oct. 12, 2011, and which is a continuation-in-part of U.S. patent application Ser. No. 13/035,329 filed Feb. 25, 2011, now U.S. Pat. No. 9,018,858, which claims benefit of U.S. Provisional Application Nos. 61/345,378 filed May 17, 2010, 61/320,545 filed Apr. 2, 2010, and 61/308,171 filed Feb. 25, 2010, and which is a continuation-in-part of U.S. patent application Ser. No. 12/566,146 filed on Sep. 24, 2009, now U.S. Pat. No. 8,378,595, which claims benefit of U.S. Provisional Application Nos. 61/105,506 filed Oct. 15, 2008, and 61/099,713 filed Sep. 24, 2008. All of the above-referenced applications are incorporated herein by reference in their entirety.

BACKGROUND

Described herein is a flexible LED lighting element that includes a flexible housing and flexible PCB to which LED units are mounted. An encapsulant fills a channel of the flexible housing and has a same or similar optical refractive index value as is used in the LED unit to hold phosphorous particles used for coloring of the LED. Use of the encapsulant changes the color of the light ultimately emitted from the flexible LED lighting module, and this factor is corrected for in calibration processes associated with the flexible LED lighting module.

SUMMARY

Disclosed herein is a flexible LED lighting element, comprising: a flexible U-shaped housing comprising arms; a flexible printed circuit board (PCB), comprising: an LED lighting unit, comprising: a unit U-shaped housing; an LED mounted to a bottom surface of the unit U-shaped housing; an LED unit encapsulent that: covers the LED; fills the unit U-shaped housing; and contains embedded phosphor particles of different colors; and an LED unit connector; and a flexible PCB trace to which the LED unit connector is connected, the trace comprising a single copper layer. The flexible LED lighting element may be bendable to a 2" radius that is parallel to the arms of the flexible U-shaped housing. The flexible U-shaped housing: may be made from flexible silicone; have cross-sectional rectangular dimensions of approximately 0.70" wide, 0.40" high, and a wall thickness of approximately 0.050"; and the flexible PCB trace is approximately 5.40 mills thick.

Disclosed herein is also a method for calibrating a flexible LED lighting element comprising at least first-, second-, and third-color LEDs, and white LEDs, as well as an LED unit encapsulent that covers the LEDs and contains embedded phosphor particles of different colors, comprising: a) defining a target color on a color map to calibrate that requires a contribution from at least the first- and second-color LEDs and white LEDs; b) selecting first and second initial calibration coefficients associated with the first- and second-color contributing LEDs that contribute to the target color, and a third initial calibration coefficient that is based on predetermined properties of the LED unit encapsulent and attributes of the white LEDs; c) storing the initial or updated first and second calibration coefficients in a non-volatile memory of the light unit; d) controlling the light unit to simultaneously drive the first and second LEDs to attempt to emit the target color, producing an attempted color, utilizing the first through third calibration coefficients; e) measuring the attempted color to determine if it matches the target color within a predefined tolerance; f) if the attempted color matches the target color, then terminating the method; g) if the attempted color does not match the target color, then performing the following; h) selecting a color component corresponding to the first-color LED; i) updating the first calibration coefficient associated with the selected color component; j) performing (c)-(f) immediately again; k) if the attempted color does not match the target color, then performing the following; l) selecting a color component corresponding to the second-color LED; m) updating the second calibration coefficient associated with the selected color component; n) performing (c)-(f) again.

Disclosed herein is also a method for calibrating a flexible LED lighting element comprising at least first-, second-, and third-color LEDs, and white LEDs, as well as an LED unit encapsulent that covers the LEDs and contains embedded phosphor particles of different colors, comprising: a) defining a target color on a color map to calibrate; b) selecting initial calibration coefficients associated with the target color, wherein one of the initial calibration coefficients is based on predetermined properties of the LED unit encapsulent and attributes of the white LEDs; c) storing: 1) the initial, or 2) updated calibration coefficients in a non-volatile memory of the light unit; d) controlling the light unit with a controller to drive the LEDs to attempt to emit the target color, producing an attempted color, utilizing one of the initial and updated calibration coefficients; e) measuring the attempted color to determine if it matches the target color within a predefined tolerance; f) if the attempted color matches the target color, then terminating the method; g) if the attempted color does not match the target color, then performing the following; h.1) selecting a first color component; i.1) adapting at least one calibration coefficient associated with the selected first color component by a first color component first amount; j.1) performing (c)-(g) again; h.2) selecting a second color component that is different from the first color component; i.2) adapting at least one calibration coefficient associated with the selected second color component by a second color component first amount; j.2) performing (c)-(g) again; h.3) selecting the first color component; i.3) adapting the at least one calibration coefficient associated with the selected first color component by a first color component second amount that is smaller than the first color component first amount and avoids an overshoot of the target color; j.3) performing (c)-(g) again; h.4) selecting the second color component; i.4) adapting the at least one calibration coefficient associated with the selected second color component by a second color component second amount that is smaller than the second color component first amount and avoids an overshoot of the target color; j.4) performing (c)-(g) again; wherein a path in a color space of the attempted colors forms: a) a converging winding path when only two color components are utilized; and b) a converging spiral when three color components are utilized.

DESCRIPTION OF THE DRAWINGS

Various embodiments are illustrated in the following drawings, in which.

DETAILED DESCRIPTION

Figure 1A:
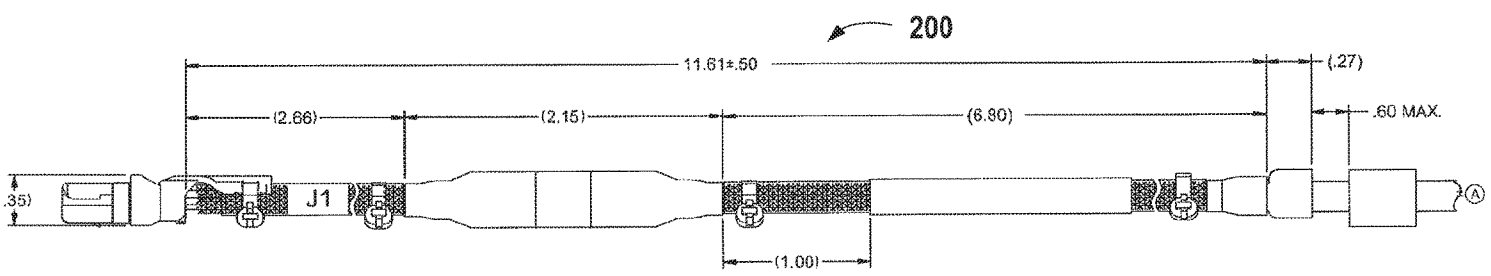
FIG. 1A and FIG. 1B are a pictorial side view of an embodiment of a flexible LED module assembly.
Figure 1B:
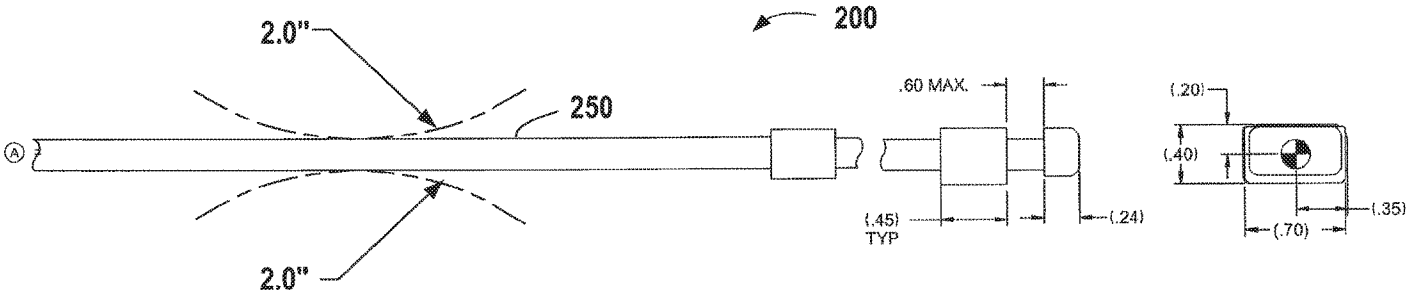
Figure 2:
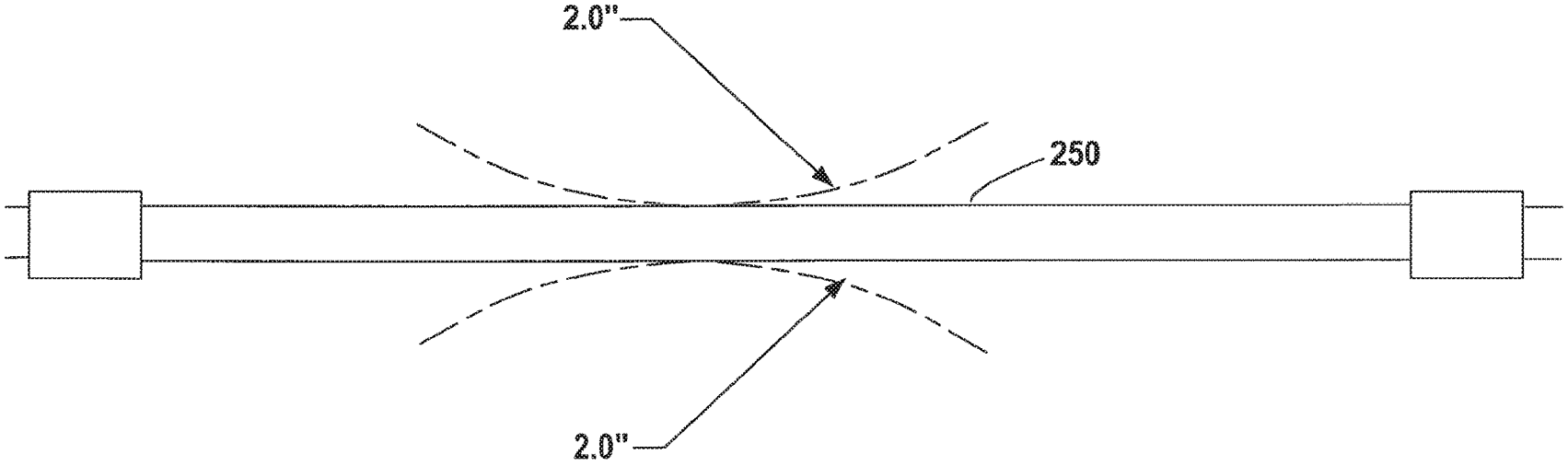
FIG. 2 is a side view illustrating a bending radius of the module assembly.
Figure 3:
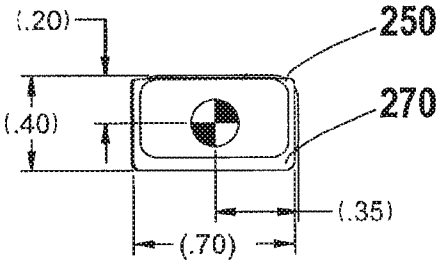
FIG. 3 is a cross-sectional view along a longitudinal axis of the module assembly.

FIG. 1A and FIG. 1B are a pictorial side view of an embodiment of a flexible (flex) LED module assembly 200. This assembly 200 comprises a flexible LED module 250 along with supporting cables, connectors, and the like. FIG. 2 illustrates a bending radius for the LED module 250 as being approximately 2.0" in a direction along a U-shaped channel of the module 250—in other words, the upper arms of the U are upright and pointing towards the top in FIG. 2. The flexible nature of the LED module 250 is due to the use of a flexible PCB with flexible traces on it, combined with a flexible housing 270. FIG. 3 is a cross-section of the module 250 and shows the flexible housing 270 along with example dimensions (inches).

Figure 4A:
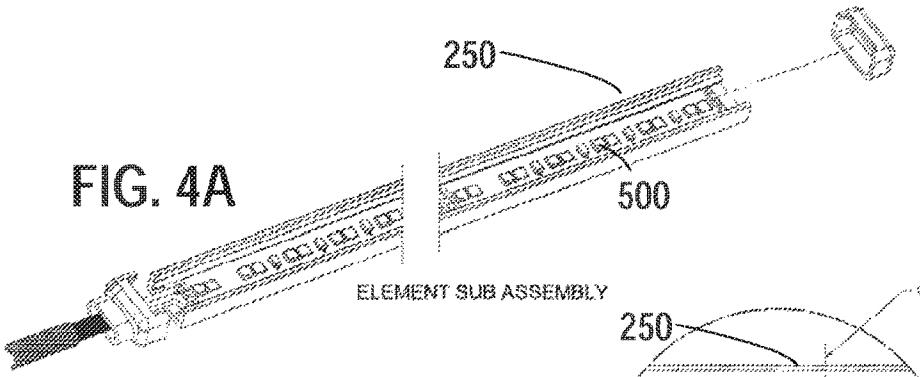
FIG. 4A is a perspective view of the module assembly.
Figure 4C:
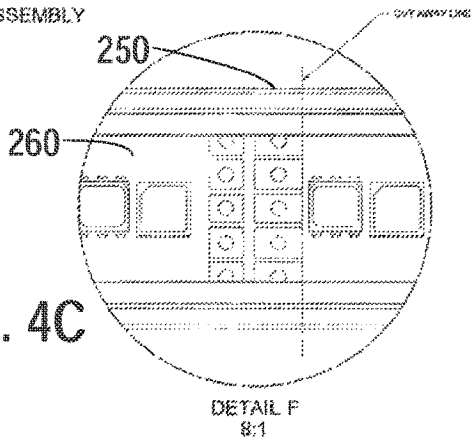
FIG. 4C is a detail plan view of the module assembly.
Figure 4E:
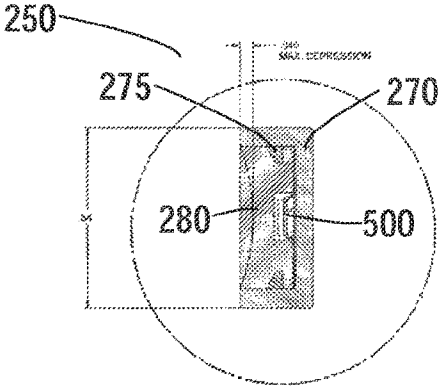
FIG. 4E is a cross-sectional detail view along the longitudinal axis of the module assembly.
Figure 4B:
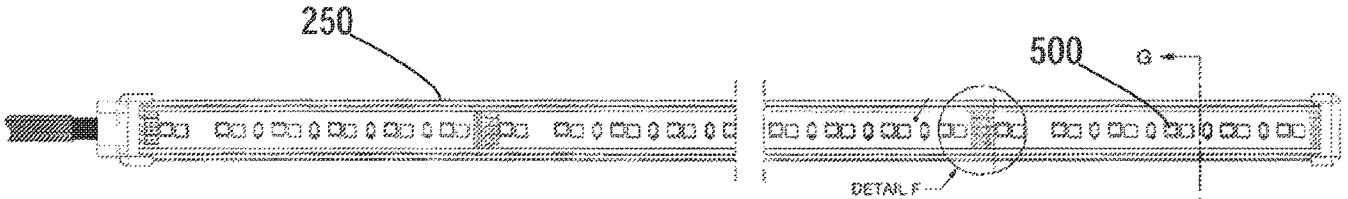
FIG. 4B is a plan view of the module assembly.

FIG. 4A is a perspective view and FIG. 4B is a plan view showing in more detail the LED module 250 with a plurality of LED units 500 on them. FIG. 4C is a plan detail view showing the circuitry mounted on a flexible PCB 260 of the LED module 250. The LEDs 500 in the module 250 may be densely spaced, e.g., on 0.5" intervals, in order to maximize the amount of light output.

Figure 4D:
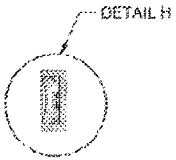
FIG. 4D is a cross-sectional view along the longitudinal axis of the module assembly.

FIG. 4D is a cross-section G-G of the LED module 250 shown in FIG. 4B, and FIG. 4E is a detail view of this cross-section. The flexible housing 270 is shown in more detail and may or may not comprise protrusions 275 in the side walls that hold in a flexible encapsulant 280 that may be based on, e.g., silicone. The flexible housing 270 is made of a flexible material, such as a known thermally conductive silicone. At a bottom portion of the housing's 270 U-shaped channel is the actual LED 500 itself.

Figure 5A:
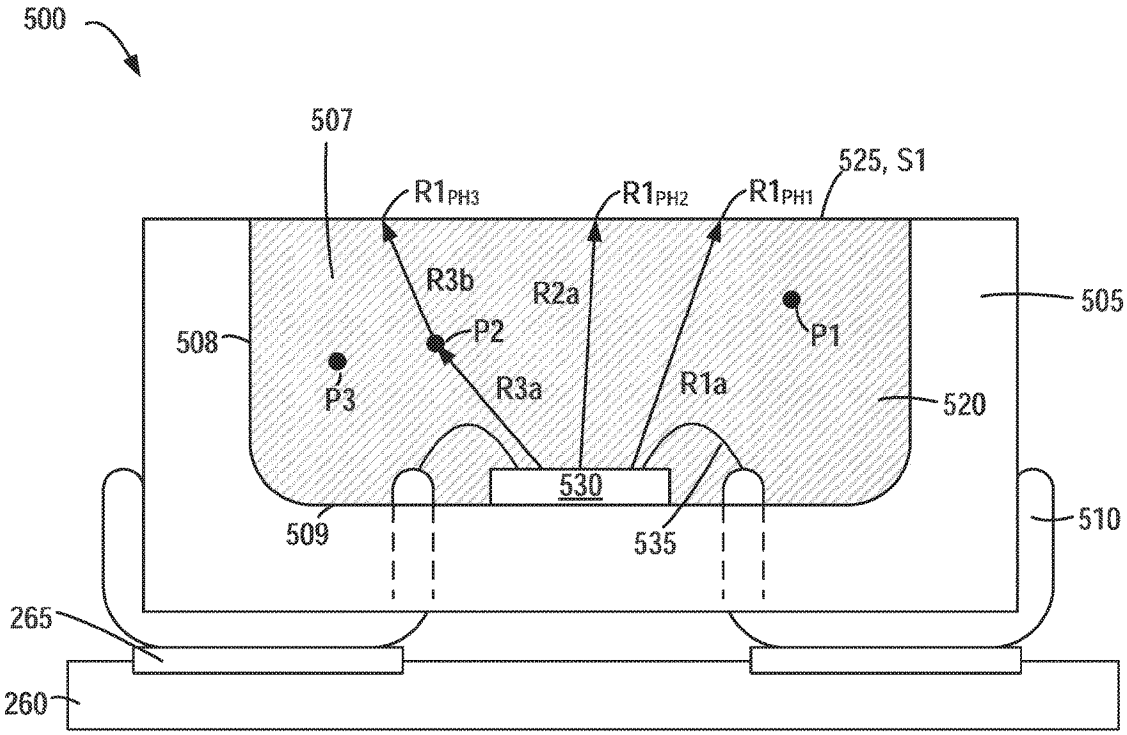
FIG. 5A is a pictorial side view of an embodiment of a flex LED unit showing emitted light rays without reflection.

FIG. 5A is a more detailed cross-sectional view of FIG. 4E, which shows that annealed heavy copper traces 265 may be used in the PCB 260, where this construction provides greater flexibility. In a typical layering for a flexible PCB, there is the laminate layer, then directly above that is a copper foil layer, and then above that is a plated copper layer, and then above that the tin or tin/lead layer. It has been determined that in order to afford the most flexibility, only a single raw annealed heavy copper layer 265 is used above the laminate layer, e.g., a 4 oz/ft$^2$ (a foil designation of 4, according to Table 1 below), since the addition of plating can cause the copper layer to be more brittle. Although the annealed heavy copper trace it is more costly than the foil layer with copper plating, the flexibility characteristics are greater. This is particularly true when the PCB 260 is coated on both sides, as is done in an embodiment. The use of the heavy single copper layer in combination with the use of extremely efficient LEDs permits a length of the flexible PCB to be as much as forty feet.

TABLE 1

Table of Thicknesses

| | | English | | | | | |
|---|---|---|---|---|---|---|---|
| Foil Designation | Metric Common Industry Terminology | Area Weight (g/m$^3$) | Nominal Thickness (μm) | Area Weight (oz./ft.$^2$) | Area Weight (g/254 in$^3$) | Nominal Thickness (mils) | |
| E | 5 | μM | 45.1 | 5.1 | 0.148 | 7.4 | 0.20 |
| Q | 9 | μM | 75.9 | 8.5 | 0.249 | 12.5 | 0.34 |
| T | 12 | μM | 106.8 | 12.0 | 0.350 | 17.5 | 0.47 |
| H | ½ | oz | 152.5 | 17.1 | 0.500 | 25.0 | 0.68 |
| M | ¾ | oz | 228.6 | 25.7 | 0.760 | 37.5 | 1.01 |
| 1 | 1 | oz | 306.0 | 34.3 | 1 | 50.0 | 1.35 |
| 2 | 2 | oz | 610.0 | 68.6 | 2 | 100.0 | 2.70 |
| 3 | 3 | oz | 915.0 | 102.9 | 3 | 150.0 | 4.05 |
| 4 | 4 | oz | 1220.0 | 137.2 | 4 | 200.0 | 5.49 |
| 5 | 5 | oz | 1525.0 | 171.5 | 5 | 250.0 | 6.75 |
| 6 | 6 | oz | 1820.0 | 206.7 | 6 | 300.0 | 8.10 |
| 7 | 7 | oz | 2135.0 | 240.0 | 7 | 350.0 | 9.45 |
| 10 | 10 | oz | 2050.0 | 342.9 | 10 | 600.0 | 13.60 |
| 14 | 14 | oz | 4270.0 | 480.1 | 14 | 700.0 | 18.90 |

TABLE 2

| Track Widths IPC Recommended Track Width For 1 oz copper PCB and 10° C. Temperature Rise | | |
|---|---|---|
| Current/A | Track Width(mil) | Track Width(mm) |
| 1 | 10 | 0.25 |
| 2 | 30 | 0.76 |
| 3 | 50 | 1.27 |
| 4 | 80 | 2.03 |
| 5 | 110 | 2.79 |
| 6 | 150 | 3.81 |
| 7 | 180 | 4.57 |
| 8 | 220 | 5.59 |
| 9 | 260 | 6.60 |
| 10 | 300 | 7.62 |

One of the problems encountered with the flexible design disclosed herein is that the LED flex modules 250 emit a bluer light than the non-flex counterpart that must be adjusted for. This is due to the flex encapsulant 280 that is introduced into the channel of the housing 270. The reason for this is the following.

FIG. 5A shows an LED unit 500 in cross-section. This unit 500 comprises a housing 505 (also U-shaped in cross-section) having a cavity 507. The cavity 507 comprises a wall 508 and floor 509. An LED unit connector 510, which is, e.g., a PCB surface mount connector, is used to mount the LED unit 500 to a PCB of the module 250 and contacts the copper trace 265 of the PCB 260. These unit connectors 510 connect with an LED 530 via internal connectors 535. Within the U-shaped cavity 507 is an encapsulant 520 that holds a number of phosphorous particles P1, P2, P3 having different colors—this is what allows the creation of a white LED unit and an adjustment of the emitted color for the reasons explained below.

Figure 5B:
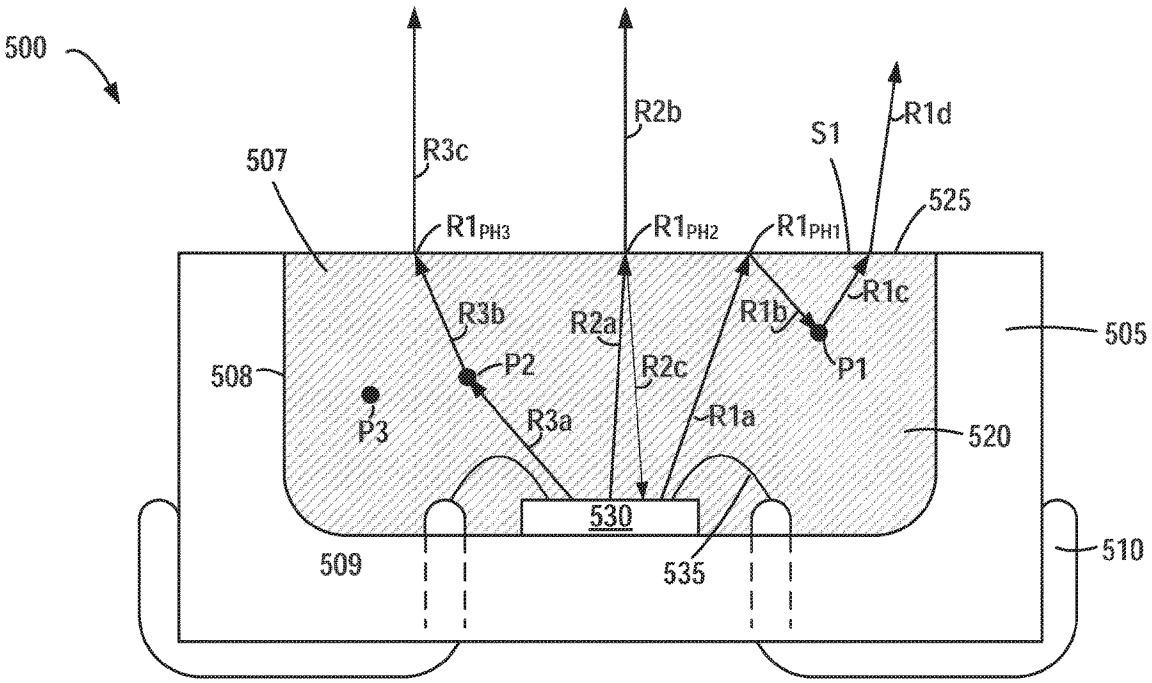
FIG. 5B is a pictorial side view of the flex LED unit showing emitted light rays with reflection but with no surrounding encapsulent.

Relatively high-energy blue-colored photons/rays R1*a*, R2*a*, R3*a* are emitted from the LED. In FIG. 5A, three colored phosphorous particles P1, P2, and P3 are shown. These particles can include particles that emit blue, red, yellow, and orange colored light and are distributed throughout the LED encapsulant 520. In FIG. 5A, only one of the light rays (R3*a*) interacts with one of the particles (P2). When the high energy ray R3*a* interacts with the particle P2, a lower energy colored ray R3*b* is emitted, and the emission can be in any random direction since this is due to an energy state change—the difference in energy is known as the Stokes' shift. FIG. 5A only shows the rays en route to the surface (S1) 525 of the LED unit 500. FIG. 5B illustrates what happens to the rays after contact with the surface 525 without the flex encapsulant 280, and FIG. 5C illustrates what happens to the rays after contact with the surface S1 with the flex encapsulant 280.

In FIG. 5B, when originating light ray R1*a* hits the surface 525, it is completely reflected back into the LED encapsulant 520 in a light ray R1*b*, which strikes a phosphorous particle P1 and emits a different colored ray R1*c* which then exits the LED unit as another ray R1*d*. Thus, the original ray R1*a* which would have had the bluish color of the LED were it not for the reflection at the surface 525, now has, e.g., a red color, due to the reflection from the surface 525. The originating Ray R3*a*, as described above with respect to FIG. 5A is not changed, since it has already directly interacted with the particle P2, and exits the LED unit in a ray R3*c*, which is, e.g., green in color.

Figure 5C:
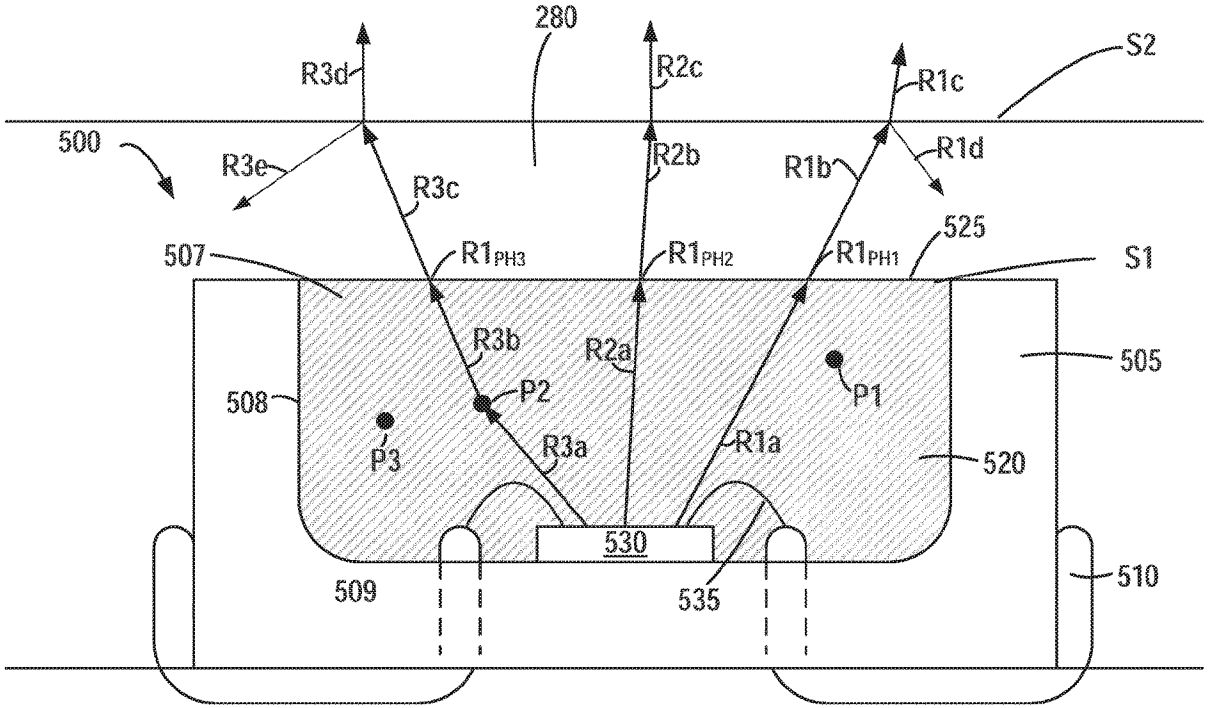
FIG. 5C is a pictorial side view of the flex LED unit showing emitted light rays with reflection with surrounding encapsulent having a refractive coefficient similar to that used for the LED unit.

FIG. 5C illustrates the situation in which the flex encapsulant 280 is present. Since the flex encapsulant 280 is made of the same or similar flexible material (e.g., silicone) (absent the phosphorous particles, although, in an embodiment, phosphorous particles may also be included in the flex encapsulant 280) as the LED encapsulant 520, non-interacting original LED light rays (e.g., R1*a*) that would have reflected back into the phosphorous embedded LED encapsulant 520 and gotten a second chance to interact with a particle (e.g., P1) are instead directed out of the LED unit (R1*b*), since the index of refraction of the two materials (flex encapsulant 280 and LED encapsulant 520) is the same. Since rays that would have been reflected but are not due to the presence of the flex encapsulant 280 now exit the LED module 250 at the surface S2, the emitted light takes on a bluer color, which must be accounted for.

Figure 6:
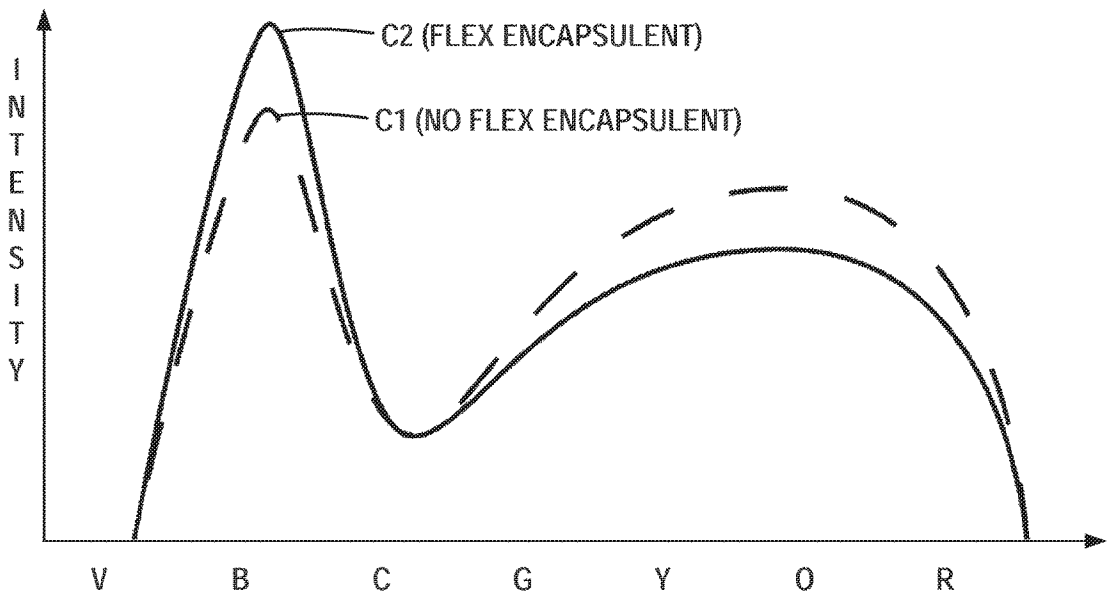
FIG. 6 is a graph that illustrates the impact on the emitted spectrum that the use of the flex encapsulant creates.

FIG. 6 is a graph that illustrates the impact on the emitted spectrum that use of the flex encapsulant 280 creates, with C1 being the intensity v. frequency curve when there is no flex encapsulant 280, and C2 being the curve when the flex encapsulant 280 is present.

Calibration procedures, such as those disclosed in U.S. Patent Publication No. 2012 0013252, herein incorporated by reference, may be utilized in calibrating the LED module 250. However, in order to properly calibrate the flex LED module 250, the color shift caused by the flex encapsulant 280 must be taken into account—for a warm white LED, the color shift may be, e.g., 900° K, whereas for a cool white LED, the color shift may be 1200° K. Thus, an adjustment factor must be included into the calibration process. The adjustment factor and calibration process can also compensate for LED intensity changes, color of the PCB mask (e.g., a white solder mask), a color shift from thermal effects, and varying flex encapsulant 280 thickness.

Figure 7:
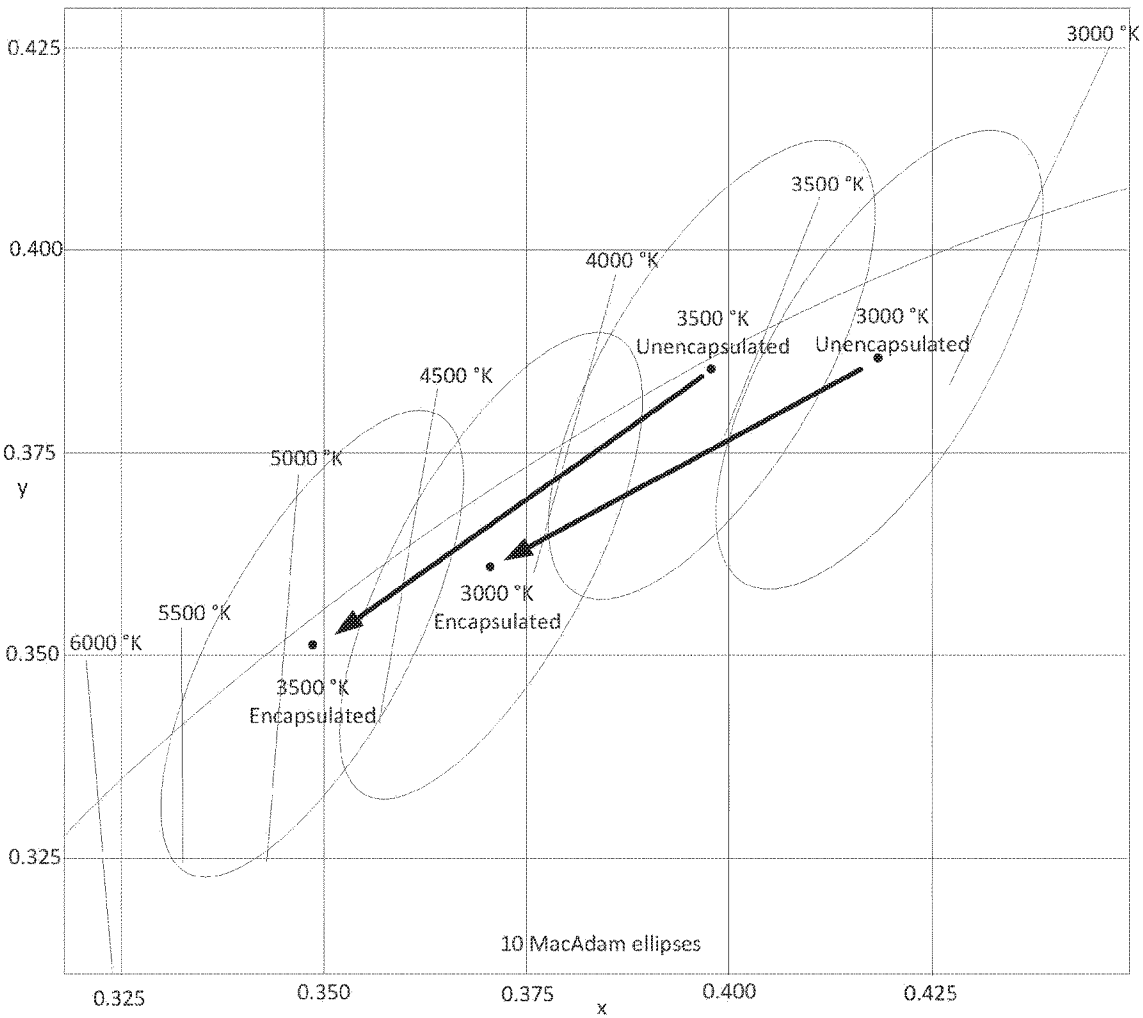
FIG. 7 is a CIE chromaticity diagram illustrating the effect of encapsulating the diodes.

FIG. 7 is a graph of a portion of a CIE chromaticity diagram illustrating the color shifts created by use of the encapsulent for both 3000° K and 3500° K LEDs. As can be seen, the use of the encapsulant shifts, in both instances, the color towards a more blue (hotter) color temperature. The following table provides example data upon which the FIG. 7 graph is based. The LED shift vs. its initial condition of the color temperature is non-linear, meaning that the shift is greater for cooler LEDs, and thus, this non-linear aspect should be taken into consideration in determining the adjustment factor.

TABLE 3

| Color Shifts for Encapsulated vs. Unencapsulated LEDs | | | | |
|---|---|---|---|---|
| | 3500 K LED | | 3000 K LED | |
| | Unencapsulated | Encapsulated | Unencapsulated | Encapsulated |
| x | 0.398 | 0.3485 | 0.4185 | 0.3705 |
| y | 0.3852 | 0.3512 | 0.3866 | 0.3609 |
| CCT | 3620 K | 4869 K | 3182 K | 4172 K |
| Shift Magnitude | 0.0601 | | 0.0544 | |
| Shift Angle | −34 | | −28 | |

Figure 8A:
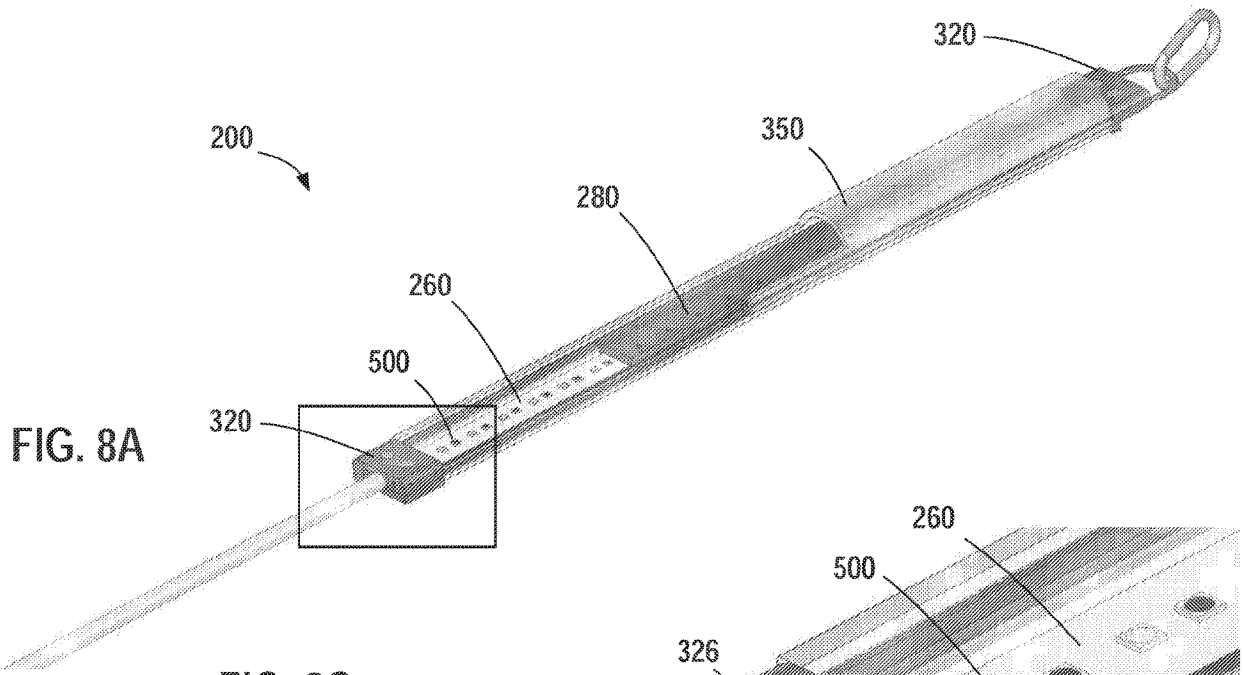
FIG. 8A is a perspective view of a further embodiment of a flexible LED module assembly.
Figure 8B:
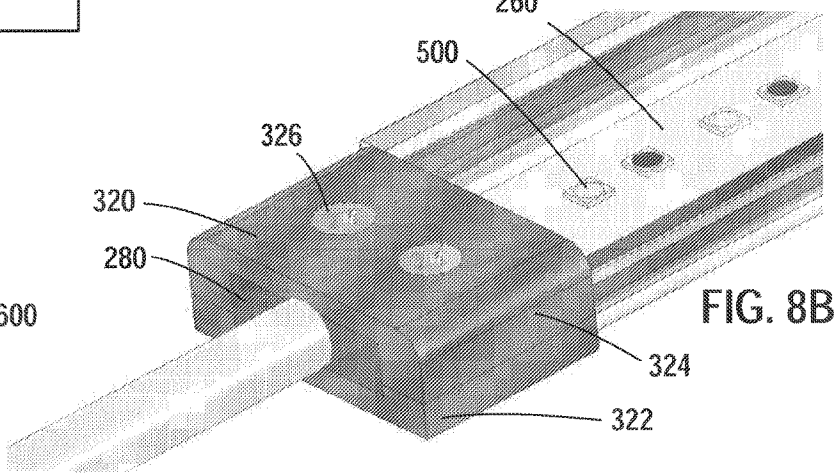
FIG. 8B is a close-up perspective view of the boxed region in FIG. 8A showing a left end of the flexible LED module assembly.
Figure 8C:
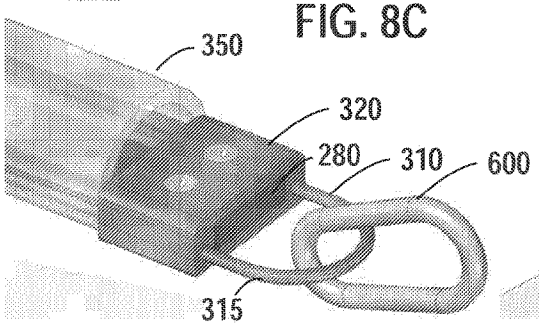
FIG. 8C is a close-up perspective view showing a right end of the flexible LED module assembly.

FIG. 8A is a perspective view of a further embodiment of a flexible LED module assembly 200. This embodiment illustrates a particular form of end caps 320 and diffuser 350. These features are illustrated in more detail in FIGS. 8B and 8C. In FIG. 8B, the end cap 320 has a bottom 322 and top 324 portion that are held together with fasteners 326 such as screws. These fasteners 326 also serve to fix the flex LED module 250 and flexible PCB 260 to the end cap 320 as well. An electrical cable (not numbered) enters the end cap 320 on one side, and is surrounded by a flex encapsulent 280 which may be the same flex encapsulent 280 that fills the assembly 200, or it could be comprised of a different material that has at least one of a flexible property and a sealing property. In FIG. 8C, the end cap 320 can be seen with two reinforcing rods 310 (discussed in more detail below) protruding from the end with a connection loop 315 joining the reinforcing rods, forming a loop through which, e.g., a lanyard 600 may be extended for fixing the assembly 200 to a particular location.

Figure 9:
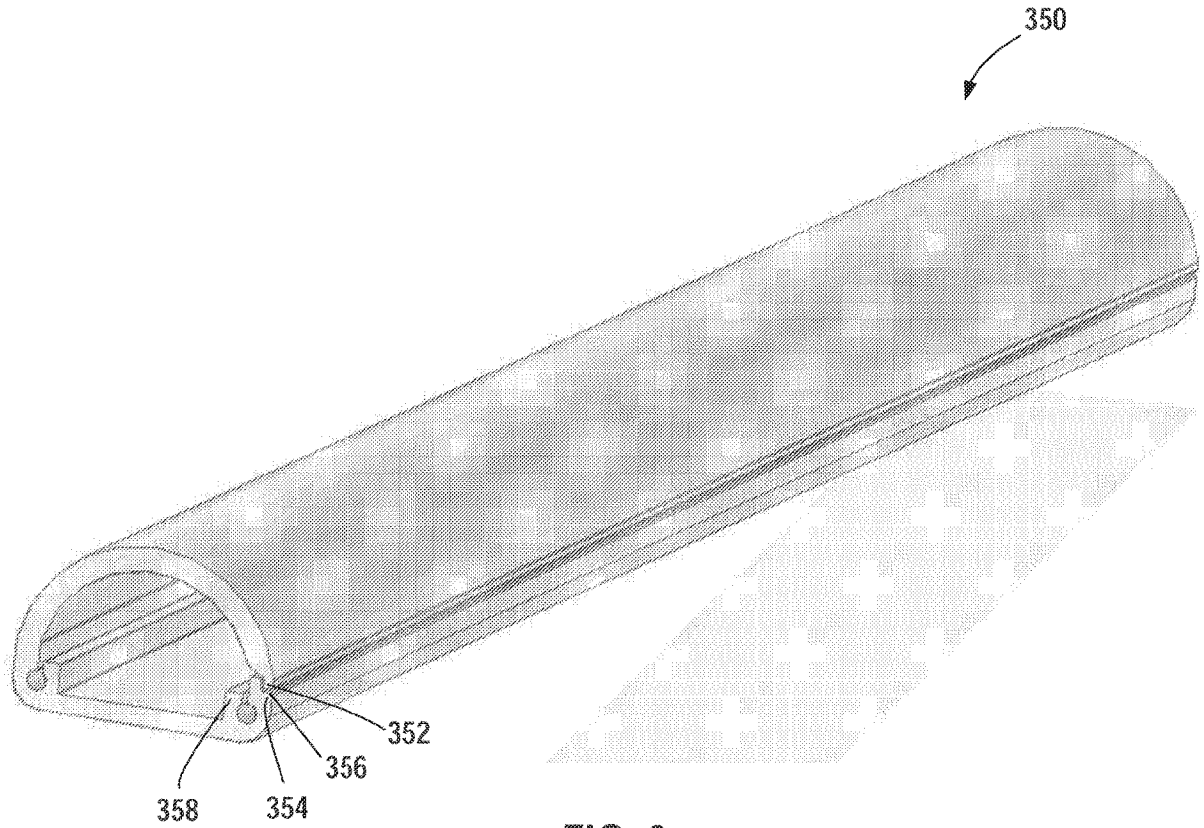
FIG. 9 is a perspective view of a diffuser.

FIG. 9 is a perspective view of a diffuser 350 that can be utilized to provide an even light and prevent hot spots by suitably locating a top portion of the diffuser 350 away from LEDs 500 of the unit. The diffuser may be constructed with a gap 356 on one side formed by a meeting of a top edge 352 and bottom edge 354 on one side of the diffuser 350. The diffuser may have an inner protrusion 358 that forms a portion of a wall for holding the reinforcing rod.

Figure 10:
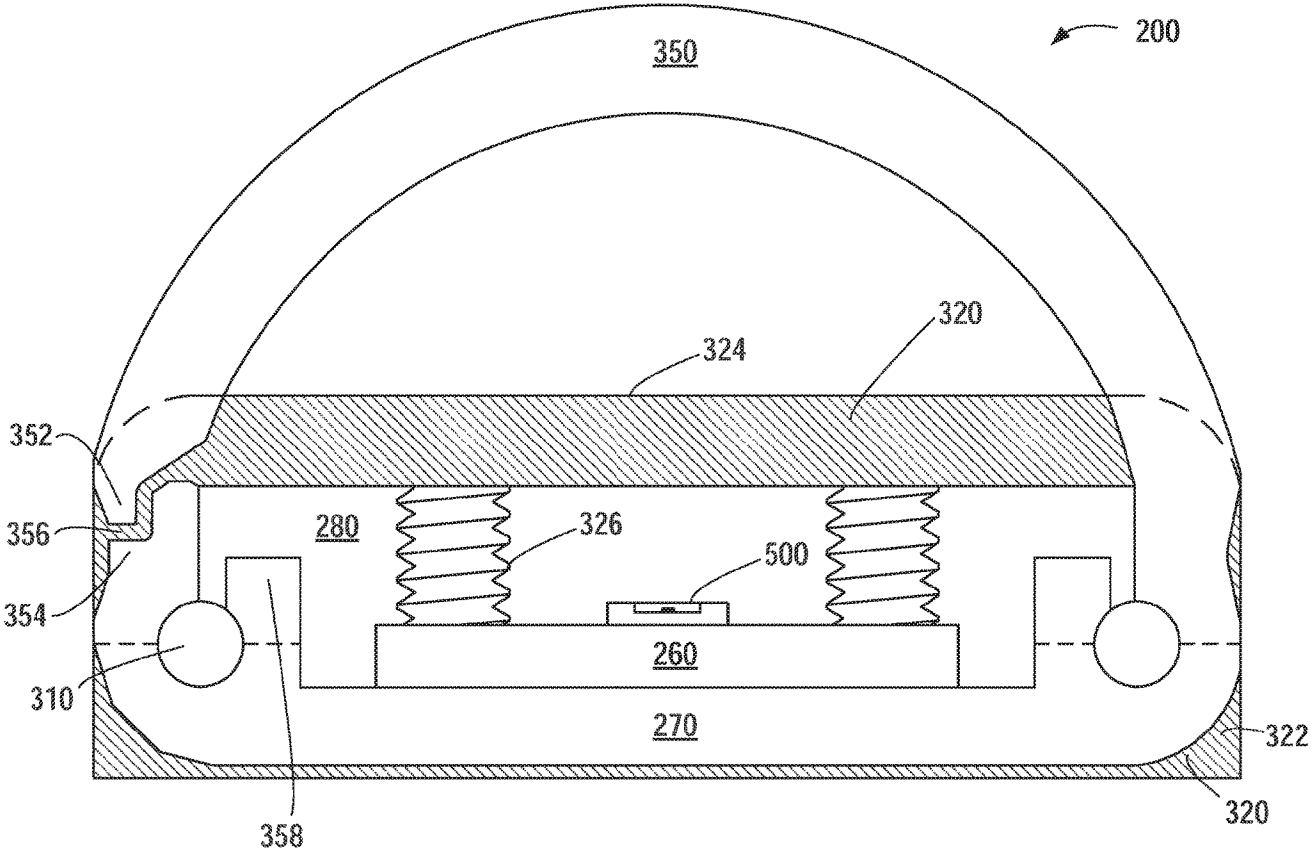
FIG. 10 is a cross-sectional view down a longitudinal axis of the embodiment shown in FIG. 8A.

FIG. 10 is a cross-sectional view of the embodiment shown in FIG. 8A, and shows the relationship between portions of the end cap 320 with respect to the diffuser 350 and the flexible PCB 260 with LED 500 mounted on it. As can be seen in FIG. 10, the main cavity of the unit is filled with the flex encapsulent 280. Also shown are the reinforcing rods 310. These rods 310 extend longitudinally down the length of the LED module assembly 200. In an embodiment, these rods 310 are made of a conductive metal that, in addition to providing a strengthening reinforcement, may provide grounding and possibly heat sinking functions. They also help protect the flexible PCB 260 from damage, since the reinforcing rods 310 would absorb most of the bending or tensile forces in the unit 200. Metallic rods 310 can be made of steel if strength properties are most important, copper if conductive properties are most important, or any other metal that has desirable characteristics. The rods can provide a ground for high voltage AC applications for additional safety and for electrostatic discharge (ESD) protection.

However, other materials can be used, and these materials may have similar characteristics to metal, or can have different characteristics. For example, for cost and other reasons (stress characteristics, etc.), nylon rods 310 could be used. However, the conductive nature of the rods 310 is lost when the material is nylon or other non-conducting material. Referring back to FIG. 8C, the rods 310 may be extended from the end cap, and a connecting loop 315 can join the two. When the rods 310 are made of a conductive material, this loop 315 can then serve to better ground the unit by linking these together. When the loop 315 is non-conductive, it can at least serve as a convenient mechanism for fastening.

Also, although a circular cross-section shape is shown, any cross sectional shape including rectangular, oblong, etc. may be used. Also, as can be seen in the cross sectional view, the top of the inner protrusions 358 are higher than, and the rod 310 is higher than or level with the PCB 260 and LED 500, thus providing additional shielding/protection, particularly cut protection. The rod 310 also allows the unit 200 to form naturally inherent catenary curves when bending corners and permits it to span gaps without structural reinforcements.

Figure 11A:
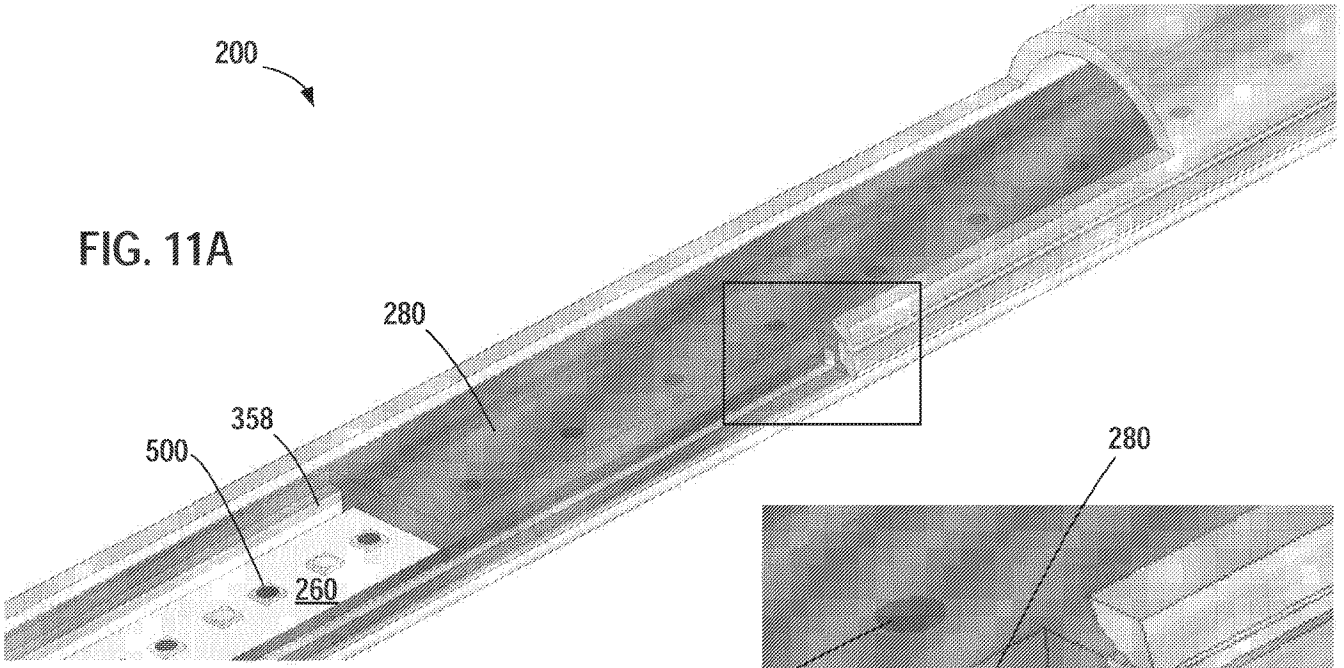
FIG. 11A is a perspective cutaway view illustrating the various components of the embodiment shown in FIG. 8A.
Figure 11B:
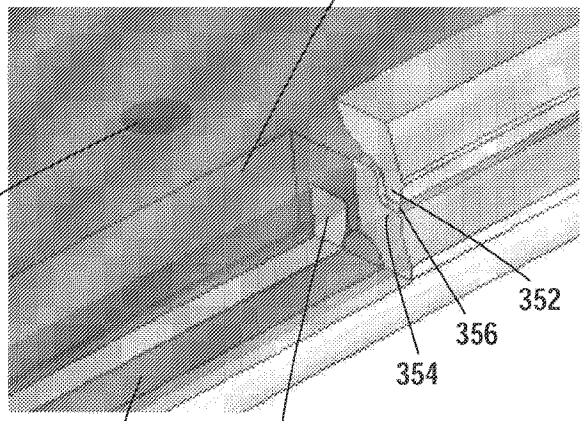
FIG. 11B is a zoomed perspective view of the boxed portion in FIG. 11A illustrating the interface of the diffuser.

FIGS. 11A and 11B are perspective cut-away views of the assembly 200. The interface can be seen particularly well in FIG. 11B where the gap 356 formed by the top 352 and bottom 354 edges is shown in relation to the flex encapsulent 280, and the construction of the diffuser 350 holding in the rods 310. The gap 356 permits the encapsulate 280 to be added by spreading the diffuser 350 open at the gap. The diffuser material, which is resilient, can then reform back into its relatively closed (optionally, but not necessarily, sealed) configuration.

Figure 12:
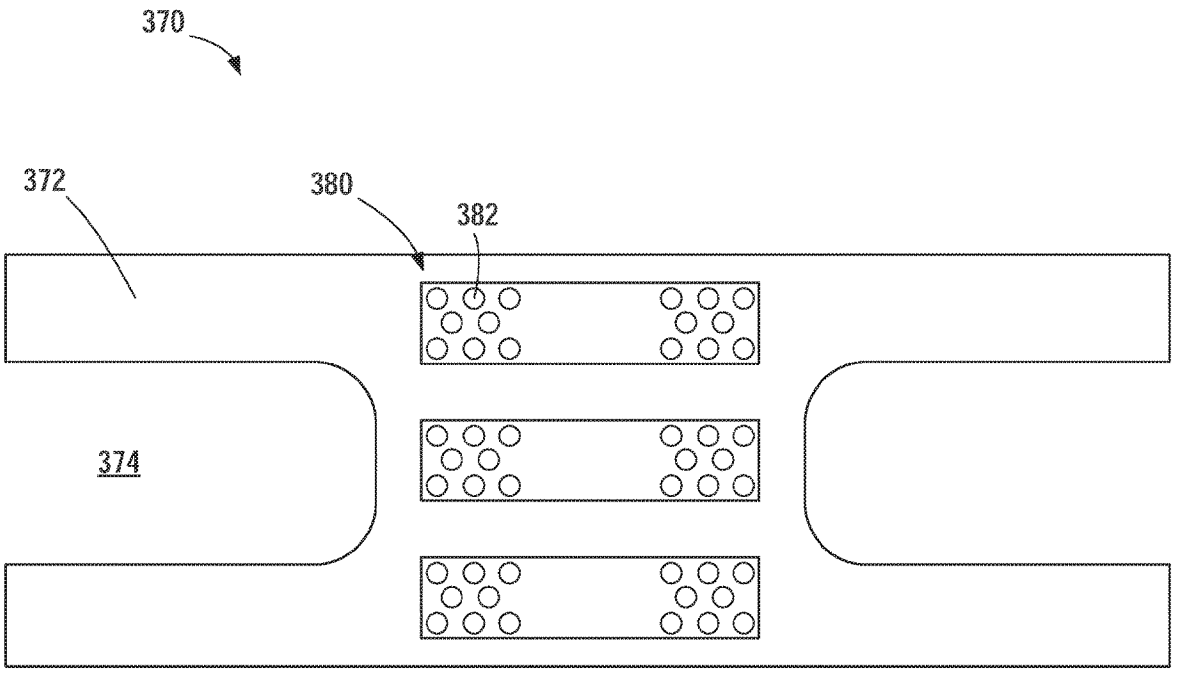
FIG. 12 is a plan view of a flexible connector element.

FIG. 12 is a plan view of a flexible connector 370 that can be used to join together two or more assemblies 200. The connector 370 is flat and relatively thin, and may be made out of metal, plastic, nylon, or any material that provides flexibility while maintaining some supportive strength that allows two connected units to bend to some degree. On each end, the connector 370 has a pair of legs 372 having in between them a U-shaped cutout region 374. The central portion constitutes an electrical connection region 380. In FIG. 12, the electrical connection region is broken down into three sub-regions (not labeled), which each constitute holes for inserting wires or a plug or pin connections. The legs 372 may be designed protrude into a bottom part of the diffuser 350 or into bottom portions of the flex module 250 itself The unit may further comprise a ground fault circuit interrupt (GFCI) as well as surge suppression. The GFCI may be implemented as a small front end PCB module that supports multiple lengths of lighting units 200. Additionally, surge/spike and ESD protection can be provided, possible on the same PCB or front end module. A separate power factor correction (PFC) and/or harmonic filter can be provided as well.

The system or systems described herein may be implemented on any form of computer or computers and the components may be implemented as dedicated applications or in client-server architectures, including a web-based architecture, and can include functional programs, codes, and code segments. Any of the computers may comprise a processor, a memory for storing program data and executing it, a permanent storage such as a disk drive, a communications port for handling communications with external devices, and user interface devices, including a display, keyboard, mouse, etc. When software modules are involved, these software modules may be stored as program instructions or computer readable codes executable on the processor on a computer-readable media such as read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion. This media is readable by the computer, stored in the memory, and executed by the processor.

All references, including publications, patent applications, and patents, cited herein are hereby incorporated by reference to the same extent as if each reference were individually and specifically indicated as incorporated by reference and were set forth in its entirety herein.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The embodiments herein may be described in terms of functional block components and various processing steps. Such functional blocks may be realized by any number of hardware and/or software components that perform the specified functions. For example, the described embodiments may employ various integrated circuit components, e.g., memory elements, processing elements, logic elements, look-up tables, and the like, which may carry out a variety of functions under the control of one or more microprocessors or other control devices. Similarly, where the elements of the described embodiments are implemented using software programming or software elements the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the embodiments of the invention could employ any number of conventional techniques for electronics configuration, signal processing and/or control, data processing and the like. The words "mechanism" and "element" are used broadly and are not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Expressions such as "at least one of," when preceding a list of elements, modify the entire list of elements and do not modify the individual elements of the list.

The use of the terms "a" and "an" and "the" and similar referents in the context of describing the invention (especially in the context of the following claims) should be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein are performable in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those skilled in this art without departing from the spirit and scope of the invention.

TABLE OF REFERENCE CHARACTERS

| |
|---|
| 200 flex LED module assembly |
| 250 flex LED module |
| 260 flexible PCB |
| 265 flexible PCB traces |
| 270 flex LED module housing |
| 275 flexible housing protrusions |
| 280 flex encapsulant |
| 310 reinforcing rod |
| 315 connecting loop |
| 320 end cap |
| 322 end cap bottom |
| 324 end cap top |
| 326 fastener/screw |
| 328 terminating silicone |
| 350 diffuser |
| 352 top edge |
| 354 bottom edge |
| 356 gap |
| 358 inner protrusion |
| 370 flexible connector |
| 372 leg |
| 374 U-shaped cutout |
| 380 electrical connection region |
| 382 holes |
| 500 LED unit |
| 505 housing |
| 507 housing cavity |
| 508 housing cavity wall |
| 509 housing cavity floor |
| 510 LED unit connector |
| 520 LED unit encapsulant |
| 525 LED unit top surface (see also S1) |
| 530 LED |
| 535 LED internal connector |
| 600 lanyard |
| Px phosphorous particles |
| Rx light rays |
| S1 LED unit top surface (see also 525) |
| S2 flex encapsulant surface |

What is claimed is:

1. A flexible lighting element, comprising:

a flexible channel having a bottom and side walls, the flexible channel being an elongate channel:

a light emitting diode module disposed on the bottom of the elongate channel, the light emitting diode module including a flexible printed circuit board, a housing coupled to the flexible printed circuit board and having a cavity, and light emitting diodes mounted in the cavity, a first encapsulant surrounding the light emitting diode and filling the cavity and a first group of embedded phosphor particles; and a second encapsulant surrounding light emitting diode module and filling the channel to a level sufficient to encapsulate the light emitting diodes, wherein the light emitting diode module emits a calibrated light which offsets a color shift caused by the second encapsulant, wherein the flexible printed circuit board includes a single-layer copper trace to which a corresponding light emitting diode is coupled.

2. The flexible lighting element of claim 1, wherein the first and second encapsulants have substantially identical refraction indices.

3. The flexible lighting element of claim 1, wherein the first group of embedded phosphor particles emit light of a first frequency.

4. The flexible lighting element of claim 3, wherein the first group of embedded phosphor particles emit substantially red light.

5. The flexible lighting element of claim 3, further comprising second and third groups of embedded phosphor particles within the first encapsulant.

6. The flexible lighting element of claim 5, wherein the second group of embedded phosphor particles emit light of a second frequency and the third group of embedded phosphor particles emit light of a third frequency.

7. The flexible lighting element of claim 5, further comprising a fourth group of embedded phosphor particles within the second encapsulant.

8. The flexible lighting element of claim 1, further comprising a diffuser covering the housing.

9. The flexible lighting element of claim 1, wherein the refraction indices of the first encapsulant and second encapsulant are selected so as to minimize internal reflection of the light emitting diodes.

* * * * *